United States Patent [19]

Ogden

[11] 4,131,279

[45] Dec. 26, 1978

[54] TENNIS RACKET AND STRINGING METHOD

[76] Inventor: John M. Ogden, 6540 Parkland Ave., Cincinnati, Ohio 45233

[21] Appl. No.: 716,425

[22] Filed: Aug. 23, 1976

[51] Int. Cl.[2] ..... A63B 51/00

[52] U.S. Cl. ..... 273/73 D

[58] Field of Search ..... 273/73 R, 73 C, 73 D, 273/73 E, 73 A

[56] References Cited

U.S. PATENT DOCUMENTS

| | | | |
|---|---|---|---|
| 1,132,214 | 3/1915 | Ries et al. | 273/73 D |
| 3,834,699 | 9/1974 | Pass | 273/73 D |

FOREIGN PATENT DOCUMENTS

| | | | |
|---|---|---|---|
| 550985 | 12/1922 | France | 273/73 D |
| 1444292 | 5/1966 | France | 273/73 D |
| 409924 | 5/1934 | United Kingdom | 273/73 D |
| 566130 | 12/1944 | United Kingdom | 273/73 D |
| 887526 | 1/1962 | United Kingdom | 273/73 D |

*Primary Examiner*—Richard J. Apley
*Attorney, Agent, or Firm*—John G. Schenk

[57] ABSTRACT

A tennis racket and stringing method are disclosed wherein the resulting racket has a more uniform main string to cross string tensioning. The uniform tensioning provides a consistent playing surface throughout the entire stringed area. The center main strings are first tensioned and the remaining main strings are tensioned by working outwardly from the center strings toward the sides. The cross strings are interwoven with the main strings beginning from the center and working outwardly.

4 Claims, 6 Drawing Figures

TENNIS RACKET AND STRINGING METHOD

BACKGROUND OF THE INVENTION

This invention relates generally to amusement devices and more particularly to an improved tennis racket and stringing method.

All tennis rackets have a "sweet spot" at the center of the racket which provides a lively reactance when struck by the ball. The "sweet spot" results from the interaction of the greatest length of main strings and cross strings. As the strings get shorter, the reactance changes. A further cause of the reactance change is the relative tightness of the main strings and cross strings.

In conventional rackets and stringing methods, the main strings are generally applied first and have a given tension. The cross strings are then interwoven, generally from either the top or bottom and then proceeding to the opposite end. FIG. 5, illustrates a conventional racket in which the cross strings are strung from top to bottom. The main string 10 is seen to be slightly bowed as the cross string 12 is added. As additional cross strings 14 and 16 are added, the main string is bowed and tension thereon is increased. Thus, it is seen that the main string 10 substantially straightens out at the bottom end. When cross strings 18, 20 and 22 are added, there is no bowing of the main string. This method of stringing also causes a change in reactance of the racket.

SUMMARY OF THE INVENTION

A tennis racket is provided having a more uniform "sweet spot". The cross strings are added from the center out to provide a more uniform tensioning of the strings. The cross strings evenly interact with the main strings to provide a uniform playing surface.

Accordingly it is an object of this invention to provide a tennis racket in which the cross strings are added from the center outward.

A further object of this invention is to provide a tennnis racket having a more uniform playing surface.

A still further object of this invention is provide a method of stringing a tennis racket which will improve the resulting racket.

Other objects, details, and advantages of this invention will become apparent as the following description of the exemplary embodiments thereof presented in the accompanying drawings proceeds.

BRIEF DESCRIPTION OF THE DRAWINGS

The accompanying drawings show present exemplary embodiments of this invention in which.

DESCRIPTION OF ILLUSTRATED EMBODIMENTS

Figure 1:
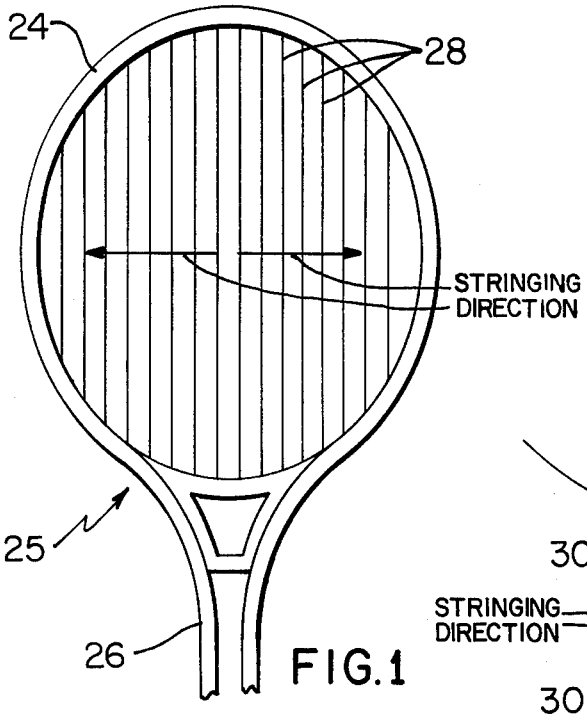
FIG. 1, is a partial top view of a tennis racket having the main strings secured therein.

Reference is now made to FIG. 1 of the drawings which illustrates an example of a tennis racket which is designated generally as 25. The racket 25 is comprised of a frame 24 terminating in a handle 26. A plurality of main strings 28 are secured to the frame 24 in any known manner and in a direction parallel to the handle 26. The strings 28 are tightened by first tensioning the longest or center main strings and then working toward the sides.

Figure 2:
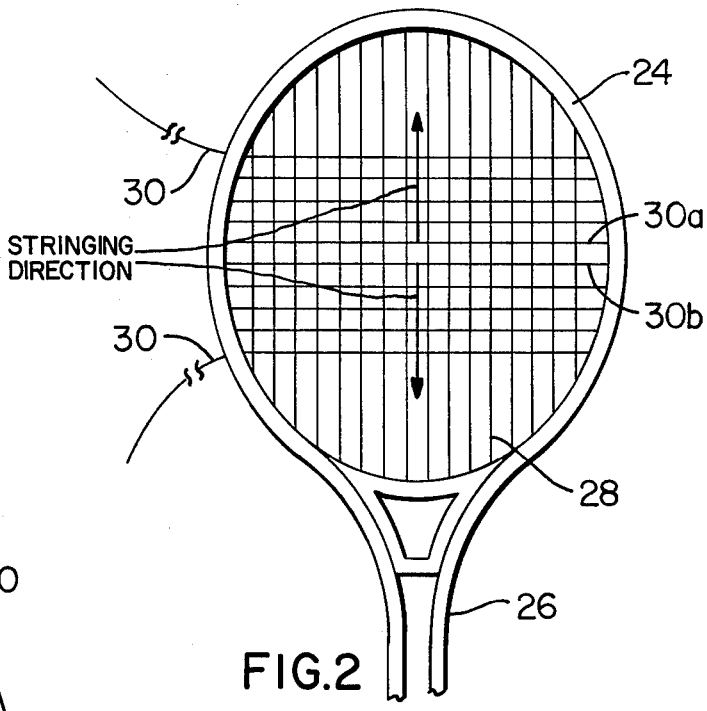
FIG. 2, is the tennis racket of FIG. 1 with the cross strings partially completed.
Figure 3:
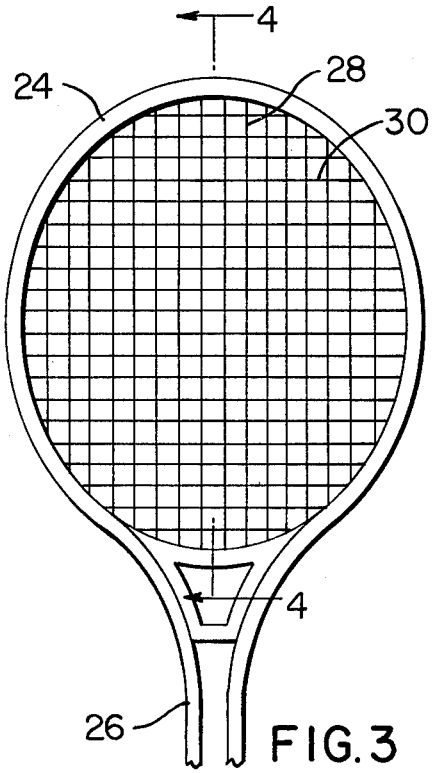
FIG. 3, is a completely strung tennis racket according to this invention.

The cross strings 30 are interwoven with the main strings 28 as seen in FIG. 2 in a direction transverse to the handle. In the illustrative embodiment described, it may be seen that a single continuous string is used. It is obvious that shorter lengths of cross strings could be used. The cross strings are tightened by first pulling or tensioning the center cross strings 30*a* and 30*b*. Each string in turn is tightened or tensioned by moving from the center outward. When the center string 30 has been tightenedin its entirety, the balance of the cross string 30 is added to the frame 24 by working from the center out towards the top and bottom respectively, as seen in FIG. 3.

Figure 4:
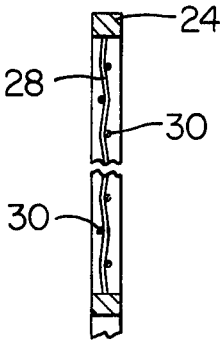
FIG. 4, is a sectional view taken along line 4—4 of FIG. 3.
Figure 5:
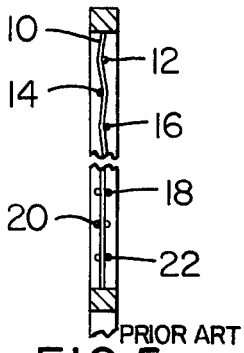
FIG. 5, is a sectional view of a prior art racket.

The center string 30 is interwoven with the main string 23, FIG. 4, so as to alternately engage the upper and lower surface of each cross string. As seen in FIG. 4, the main string 28 is substantially bowed slightly and evenly by each cross string. Since the cross strings are tightened from the center outward, the straightening of the main string is avoided. Further, the bowed portion of the main string at each cross string substantially eliminates relative movement between the main strings and the cross strings. This enhances string life and also provides for a more uniform playing surface.

Figure 6:
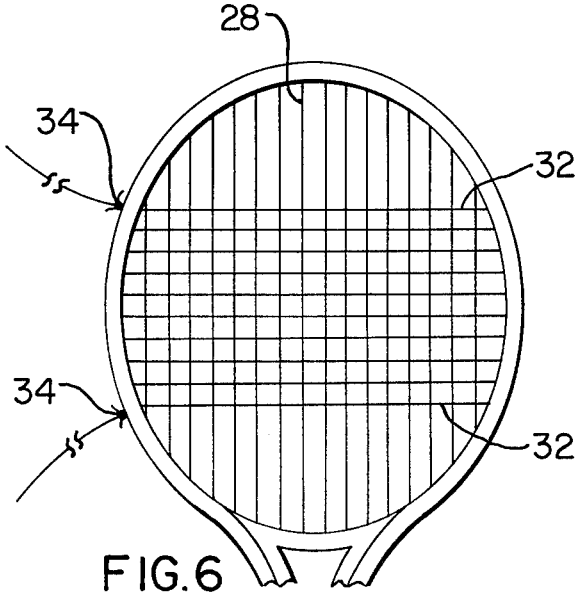
FIG. 6, is a partial top view of a modification of the tennis racket of this invention.

Another exemplary embodiment of this invention is illustrated in FIG. 6 of the drawings. In this embodiment, the cross string 32 is interwoven with the main string 28 in the manner hereinabove described. When the cross string 32 has been properly tensioned and tightened the ends of string 32 are secured at the frame 24 by suitable means such as by ties 34. Additional cross strings are then added in the manner described above.

The racket strings may be added by alternately first adding two main strings and then two cross strings, then two main strings, etc. until the frame is complete.

In other words, the two main strings are added at the center of the racket, tensioned and then secured or tied. Next, two cross strings are interwoven with the main strings at the center, tensioned and secured. Working outwardly, additional main strings and cross strings are added.

The stringing of the tennis racket by adding cross strings first at the center and then working outward allows a lower stringing tension. A uniform playing surface is presented wherein the reactance throughout the playing surface is more uniform. Accordingly, the objectives herein before set forth have been accomplished.

While present exemplary embodiments of this invention have been illustrated and described, it will be recognized that this invention may be otherwise variously embodied and practised by those skilled in the art.

What is claimed is:

1. A method of stringing a racket having an open frame and a handle, the steps comprising inserting and tensioning the main strings in the frame in a direction parallel to the handle, said strings being tensioned first at the center and then working outwardly toward the sides; and inserting and interweaving the cross strings through said main strings and beginning from the center and moving outwardly towards the top and bottom of the frame, said cross strings being tensioned first at the center and then outwardly.

2. The method according to claim 1 including the step of tying off each end of said central portion cross string at the frame, and then inserting and tensioning additional cross strings, from said central portion cross string to the top and to the bottom, said additional cross strings being tied off at the frame.

3. A tennis racket comprising an open frame; said frame terminating in a handle; a plurality of main strings parallel to said handle and secured under tension in said frame; first central portion cross string inserted and tensioned in said frame at the center thereof and interwoven with said plurality of main strings; and additional cross string inserted in said frame and interwoven with said main strings, said additional cross strings being added from said first central portion cross string outwardly toward the top and bottom of said frame and said additional cross string being tensioned from said central portion cross string outwardly.

4. A tennis racket comprising an open frame; said frame terminating in a handle; a plurality of main strings parallel to said handle and secured under tension in said frame, said strings being first tensioned at the center and then outwardly; a plurality of cross strings interwoven with said main strings and secured under tension in said frames; and said main strings and cross strings being secured under tension in said frame from the central portion and then outwardly therefrom.

* * * * *